United States Patent [19]

Goff, Jr. et al.

[11] 3,989,237

[45] Nov. 2, 1976

[54] VARIABLE FORCE SHEET FEEDING MECHANISM

[75] Inventors: Willie Goff, Jr., Lexington, Ky.; Lowell M. Simson, Lafayette, Colo.

[73] Assignee: International Business Machines Corporation, Armonk, N.Y.

[22] Filed: May 5, 1975

[21] Appl. No.: 574,220

[52] U.S. Cl. ..... 271/19; 271/120

[51] Int. Cl.[2] ..... B65H 3/02; B65H 3/54

[58] Field of Search ..... 271/19, 20, 21, 22, 271/23, 24, 25, 18, 120, 119, 115

[56] References Cited

UNITED STATES PATENTS

| | | | |
|---|---|---|---|
| 418,942 | 1/1890 | Crane et al. | 271/25 |
| 1,517,254 | 12/1924 | Scholin | 271/25 |
| 3,325,164 | 6/1967 | Kedzierski | 271/21 |
| 3,350,089 | 10/1967 | Niccoli | 271/21 X |
| 3,425,685 | 2/1969 | Liva | 271/21 |
| 3,649,003 | 3/1972 | Muller et al. | 271/120 |

OTHER PUBLICATIONS

Froula, J. D. and L. M. Simson, "Variable Force Sheet Feeding Mechanism", *IBM Technical Disclosure Bulletin*, vol. 18, No. 2, July 1975, p. 329.

*Primary Examiner*—John J. Love
*Assistant Examiner*—Bruce H. Stoner, Jr.
*Attorney, Agent, or Firm*—Francis A. Sirr

[57] ABSTRACT

A buckling type paper sheet feeding mechanism wherein the top sheet of a stack is separated from the underlying sheet by first driving the front sheet edge in a rearward direction against a rear restraint, causing the top sheet to buckle, and then reversing the direction of sheet drive, causing the top sheet to be fed in a forward direction over a front stack edge restraining or hold-down means. The top sheet is moved rearward by a variable force means which provides a progressively increasing buckling force, to thereby ensure reliable feed of paper of varying types, weights and humidity content, while at the same time minimizing the possibility of double sheet feed. A variable position rear restraint moves rearward, in synchronism with operation of the variable force means, to increase the column length of the top sheet as the buckling force increases.

26 Claims, 4 Drawing Figures

VARIABLE FORCE SHEET FEEDING MECHANISM

BACKGROUND AND SUMMARY OF THE INVENTION

Sheet buckling sheet feeding mechanisms are known wherein a normally stationary friction drive roller sits on the top sheet of a stack of sheets. When this roller is energized, it first rotates to move the top sheet rearward, forming a transverse hump or buckle in the top sheet, thus moving the sheet's forward edge out from under a hold-down blade at the front of the stack. After this buckle has been formed, and perhaps sensed by a switch, the rotational direction of the drive roller is reversed. The top sheet now moves forward, over the hold-down blade. The now separated top sheet is then fed into a sheet utilization path by downstream feed rollers, which may include a top feed roller, rotating to feed the sheet in the forward direction, and a bottom restraint roller, rotating opposite to the forward direction, to inhibit the feeding of more than one sheet.

In general such sheet feeding mechanism confines the rear edge of the sheet stack to limit rearward movement such that a buckle can be formed. This rear edge confinement may include a means which holds down the rear edge of the stack. The front edge of the stack is held down, to define a blade, clip or the like, over which the top sheet travels after the buckle has been formed, and the sheet's direction has been reversed from rearward to forward. During rearward movement, the sheet's forward edge is withdrawn from under the front edge hold-down means, as the buckle is being formed.

A common problem with known sheet feeding mechanisms is that of double sheet feeding, that is the feeding of more than the top sheet. This is due to the fact that the coefficient of friction between the paper drive element and the top surface of the top sheet varies with paper type, weight and moisture content, as does the coefficient of friction between the top sheet and second sheet in the stack. It is very difficult to adjust such a paper drive roller so that it will consistently separate only the top sheet.

The present invention provides a buckling type sheet feeding mechanism wherein single-sheet feed is reliably obtained by the use of a variable force means which operates to increase its sheet driving force as a function of feed cycle time. As a result, the top sheet begins to move rearward whenever this variable force reaches the unique required force for that particular sheet at that particular time. The force profile of this variable force means spans a force range into which many sheet types, weights and moisture contents fall. Thus, these sheets are reliably fed, one at a time, and means such as the above-mentioned restraint roller usually are unnecessary.

More specifically, the variable force means of the present invention may be provided, without limitation thereto, by a band spring whose relaxed position is out of engagement with the top sheet of a stack of sheets. To buckle the top sheet the spring is unwound such that a spring loop bows outward to engage the top sheet and move it rearward. A loop stop member is positioned to confine this loop expansion such that the rearward drive force increases as the loop size increases. When a given size loop has been formed the spring loop is allowed to quickly relax. In so relaxing, the top sheet, which has been previously buckled, is moved forward and separated from the stack.

As a further feature of the present invention, the rear of the sheet stack is held down by a second band spring. This second spring is wound in synchronism with the first-mentioned band spring to move its contact to the top sheet toward the rear edge of the sheet. In this way, the effective column length of the top sheet increases as the buckling force on the sheet increases. This effect aids in preventing a double sheet feed in almost any environment.

The foregoing and other features and advantages of the invention will be apparent from the following more particular description of preferred embodiments of the invention, as illustrated in the accompanying drawing.

DESCRIPTION OF THE PREFERRED EMBODIMENTS

Figure 1:
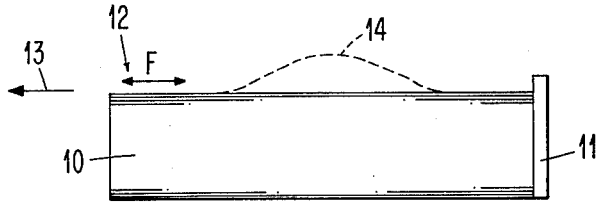
FIGS. 1 and 2 show a conceptual view of the present invention wherein buckling force profile F operates over a relatively long time interval to buckle the top sheet, and operates over a relatively short time interval to feed the now-separated sheet forward.
Figure 2:
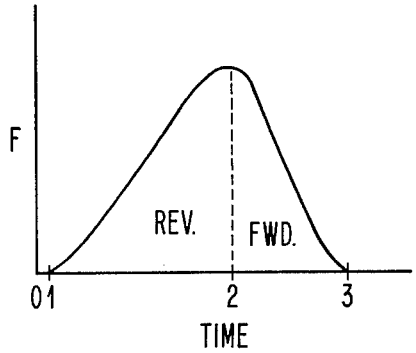

Referring to FIGS. 1 and 2, these figures are helpful in understanding the present invention. Reference numeral 10 identifies a stack of paper sheets whose rear edge is registered against a fixed position guide or restraint 11. A forward portion of the sheet, identified by reference numeral 12, is subjected to a variable magnitude and direction force, represented by arrow F. As shown in FIG. 2, at time 0, no force is exerted at the portion 12 of the top sheet on the stack. This corresponds to the standby condition wherein there is no need to feed the top sheet into the sheet utilization path represented by arrow 13. When such a need arises, the variable force sheet feeding mechanism of the present invention is placed into operation, and a short time thereafter, force F first engages the sheet, as shown at time 1 in FIG. 2. This variable force profile, from time 1 to time 2, gradually increases over a relatively long time period defined by times 1 and 2, for example generally less than one second. The direction of force F is toward rear restraint 11, so as to accomplish a desired buckle or hump 14 within the top sheet at time 2. When this buckle has been formed, the direction of force F is quickly reversed to feed this top sheet into sheet utilization path 13. The force profile during the forward sheet movement quickly falls off to zero, as represented by the force profile between times 2 and 3.

It has been found that the variable force profile, particularly between time 1 and time 2, allows the top sheet of stack 10 to be reliably and repeatably separated from the next sheet thereunder. This reliable separation is reasonably independent of the sheet's weight, texture, moisture content, etc. Once buckle 14 has been formed, the top sheet is effectively separated and the force profile achieved between time 2 and time 3 is not critical, with the exception that the force must reverse direction to move the sheet in the forward direction toward the sheet utilization path.

Figure 3:
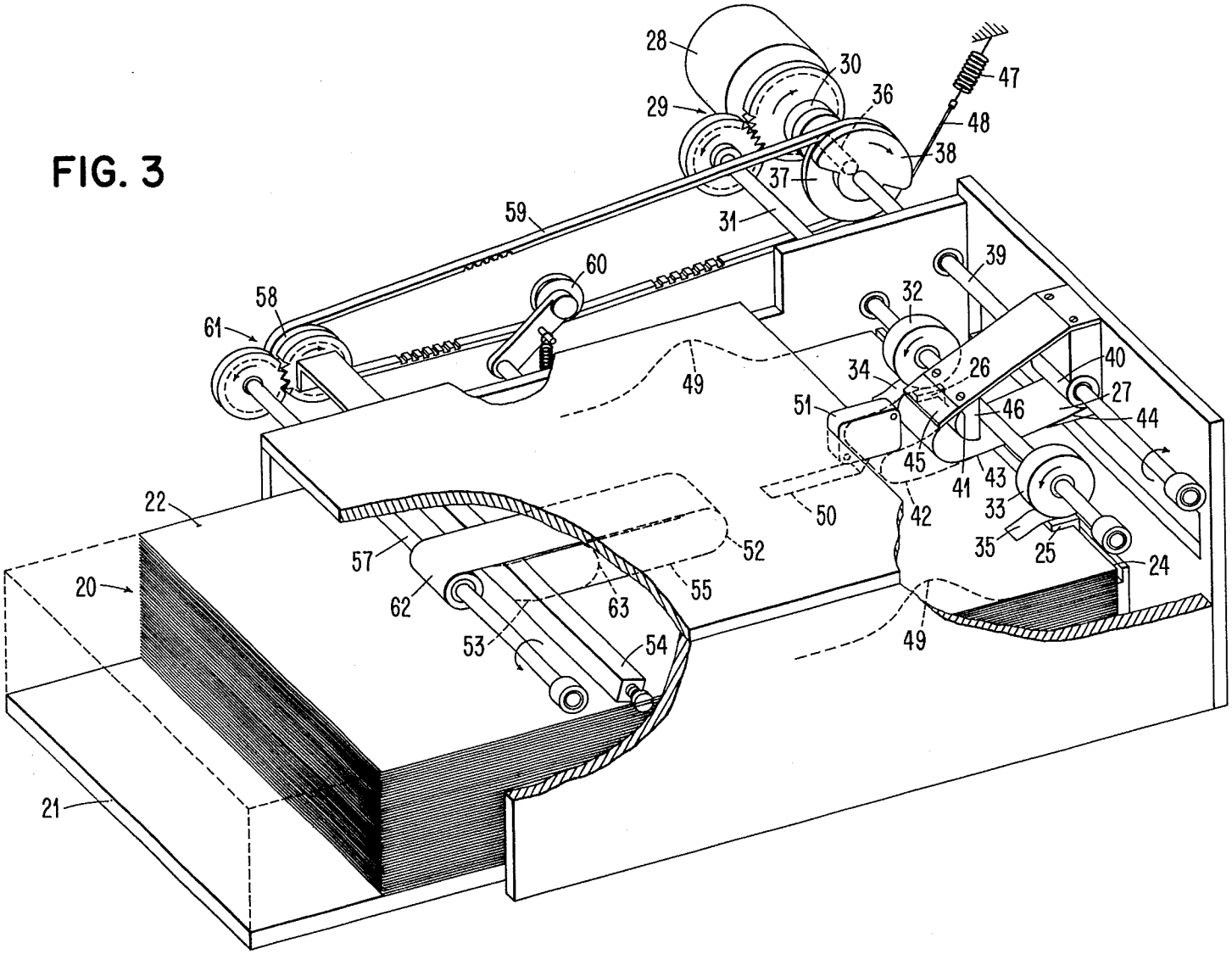
FIG. 3 is a perspective view of a first embodiment of the present invention, wherein the variable force means comprises a band spring.

FIG. 3 discloses the perspective view of a first embodiment of the present invention, wherein the variable force F of FIGS. 1 and 2 is provided by a variable force means comprising a band spring. The apparatus of the present invention differs from state of the art mechanisms in that the state of the art mechanisms use essentially a fixed geometry with respect to the column length of the paper to be buckled, the drive force exerted on the paper, and the contact area between the drive force and the paper. This fixed geometry is selected in the state of the art devices to provide a maximum reliable operating range between the failure points which occur in multiple-sheet buckling with thin paper and drive slippage with thick paper. The present invention varies one or more of the three parameters of column length of the paper to be buckled, drive force, and contact area for the drive force, to thus increase the operating range of sheet characteristics which may be reliably fed.

In FIG. 3, a stack of sheets 20 rests on a movable, elevating platform 21 such that the top sheet 22 thereof is always maintained at the elevation shown. A stack height sensing means and a platform position control means is provided, but not shown, to maintain the top sheet at this elevation. The forward edge 24 of the stack is held down by spaced edge restraints 25 and 26.

The variable force sheet feeding mechanism of FIG. 3 is shown in its nonfeed, standby condition, wherein the variable force means comprising band spring 27 is out of physical contact with the top surface of the top sheet. At this time motor 28 is energized, such that gear train 29 rotates in the direction shown. However, clutch 30 is deenergized. Rotation of gear train 29 is imparted to shaft 31, causing sheet drive rollers 32 and 33 to rotate in the direction shown. These rollers cooperate with thin spring fingers 34 and 35 to form a sheet drive nip which will be effective to advance the separated top sheet of the stack to the sheet utilization path, generally to the upper right of the mechanism disclosed in FIG. 3.

When it is desired to feed the top sheet of the stack into the sheet utilization path, clutch 30 is energized. Energization of this clutch causes shaft 36 to be connected to the output shaft of motor 28. Rotation of this shaft, in a clockwise direction, causes rotation of pulley 37, cam 38 and shaft 39. The relaxed position of band spring 27 is such that it is wound to form a spool 40, whose inner end is attached to shaft 39. Clockwise rotation of this shaft causes the spring to unwind. The other end of the spring is anchored at 41. As a result of clockwise rotation of shaft 39, an ever-extending loop, represented by broken lines 42, is formed. Shortly after shaft 39 begins rotating, the portion 43 of the band spring engages the top surface of the top sheet of paper. Portion 43 supports a suitable friction material, such as rubber, which is operable to move the top sheet in a rearward direction. This rearward movement is effective to move the front edge of the top sheet out from under the front restraining means formed by means 25, 26 and 34, 35.

As the ever growing loop is formed, it is confined by stationary surface 44 and stationary loop restraint 45. The buckling force exerted on the top sheet is a function of the friction coefficients of the surface 43 and of the sheet. This force increases, as disclosed in FIG. 2 from time 1 to time 2, as the loop lengthens. An internal spring support block 46 is curved to control the bending of band spring 27, and particularly to prevent the spring from buckling upward between roll 40 and the area of paper contact. Support block 46 also serves as a spring stop during the subsequent forward feed cycle, to be explained.

As shaft 39 rotates clockwise, spring 47 is stressed, as cable 48 wraps about the surface of cam member 38. Whenever the top sheet has buckled enough, as represented by broken lines 49, switch operator 50 is engaged by the buckle and switch 51 is then operable to deenergize clutch 30. The interconnecting electrical circuitry is not shown. Spring 47 is now operable to institute counterclockwise rotation of shaft 39. Band spring 27 is now quickly restored to its standby position, as shown in FIG. 3, during the relatively short time interval from time 2 to time 3 in FIG. 2. This restoration movement of band spring 27 imparts forward movement to the top sheet, causing the forward edge of the top sheet to be driven into the drive nips formed by 33, 35 and 32, 34.

As a further feature of the present invention, the column length of the top sheet, that is the length of the top sheet from the point of force engagement of band spring 27 to the point of engagement by a rear restraint, is synchronously increased as the buckling force increases. Specifically, this function is provided by a second band spring 52. The end 53 of this band spring is attached to the undersurface of the square cross-section bar 54. Bar 54 is inclined to the plane of the paper stack such that the bottom portion 55 of the loop continuously engages the top sheet. The upper portion of the loop is constrained by a plate, not shown, which extends parallel to the top sheet.

When clutch 30 is energized, as above described, shaft 57 begins to rotate counterclockwise, by means of the power train composed of pulley 58, cogged timing belt 59, tension retaining pulley 60, and gear train 61.

This counterclockwise rotation of shaft 57 causes band spring 52 to wrap about pulley 62, causing the loop to retreat toward the rear edge of the sheet, as shown by broken line 63. The proportioning of the parts is such that loop 52 retreats faster than the loop formed by band 27 advances. Thus, the distance between these two loops increases, thereby increasing the column length of the sheet to be buckled, as the buckling force increases. This variable column length aids in the separation of sheets of widely differing buckling characteristics.

The present invention provides a variable force sheet feeding mechanism wherein the sheet buckling force covers a continuously variable range of buckling forces, exemplified by the force profile during time interval time 1 to time 2 of FIG. 2, such that within each feed cycle the buckling force extends well below and well above the force normally required to buckle sheets having a wide variety of characteristics resisting this buckling. The continued displacement of band spring 27, after contact with the paper occurs, causes not only the buckling force to increase, but also causes the total loop contact area to the top surface of this top sheet to increase. This feature of the present invention decreases the probability of slippage between this drive means and the top sheet. This feature, in combination with the retreating loop formed in band spring 25, provides an increasing column length for the sheet to be buckled, thereby reducing the maximum force required to buckle a difficult-to-buckle sheet. The smaller this buckling force can be maintained, the less is the probability of buckling more than one sheet.

If lower inertia mechanisms are desired, such as in an excessively high speed sheet feed system, clutch 30 can be eliminated and individual clutches can be provided on shafts 39 and 57, located physically close to the two band springs. Such a construction will reduce the system inertia to a minimum.

Figure 4:
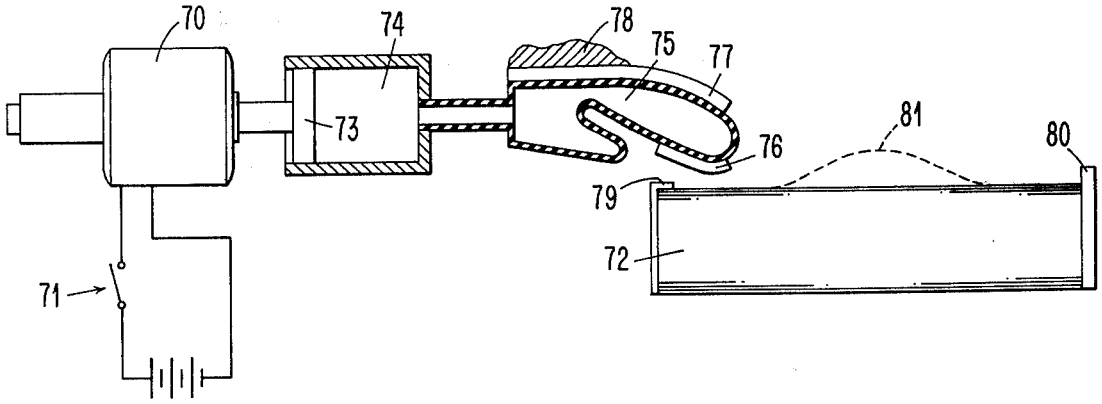
FIG. 4 is a side view of a second embodiment of the present invention, wherein the variable force means comprises a pneumatic actuator.

FIG. 4 is a side view of a second embodiment of the present invention, wherein the variable force means comprises a pneumatic actuator. This arrangement eliminates the drive shaft, gears and the like shown in the embodiment of FIG. 3. In the arrangement of FIG. 4, solenoid 70 is energized, as by switch 71, when it is desired to feed the top sheet from stack 72. Energization of solenoid 70 drives piston 73 to the right, compressing the fluid, for example air, within closed chamber 74. This pressurized air then flows to balloon-like diaphragm 75, causing the friction pad 76 carried thereby to move into engagement with the top sheet of the stack. The expansion of diaphragm 75 is controlled by stationary plate 77, this plate being mounted as at 78. The force exerted on the top sheet by the expanding diaphragm causes the top sheet to separate and pull out from under forward restraint 79, as the rear edge engages rear restraint 80. As a result, buckle 81 is formed in the top sheet. A switch means, not shown, is provided to sense this buckle and to deenergize solenoid 70. The compressed air within chamber 74 now operates to quickly restore piston 73 to the position shown, causing the leading edge of the top sheet to be driven over front restraint 79, and into a sheet drive means and sheet utilization path, not shown.

The mechanism of FIG. 4 may include the variable column length rear sheet edge restraint means as provided in FIG. 3, in which case the column length of the top sheet will increase as the pressure within chamber 74 increased, that is as friction surface 76 advances to the right.

While the invention has been particularly shown and described with reference to preferred embodiments thereof, it will be understood by those skilled in the art that various changes in form and details may be made therein without departing from the spirit and scope of the invention.

What is claimed is:

1. A variable force sheet feeding mechanism operable to separate the top sheet from a stack of sheets by first moving the top sheet to the rear, to form a buckle therein as the top sheet is separated from the next sheet in the stack, and thereafter to move the top sheet forward, the improvement comprising:

variable magnitude and direction force means associated with a portion of the front of the top sheet, comprising a band spring whose relaxed position places said band spring out of contact with said top sheet, unwinding of said band spring producing said rearward sheet movement, and return of said band spring to said relaxed position producing said forward sheet movement, and cyclically operable means controlling said force means causing said band spring to unwind and to engage said top sheet with a force profile which increases as a function of time during said unwinding, and to thereafter cause said band spring to return to said relaxed position and drive said top sheet forward, said force profile decreasing as a function of time during the return of said band spring to said relaxed position.

2. The sheet feeding mechanism defined in claim 1 wherein said band spring disengages said top sheet after completing the forward drive of said top sheet.

3. The sheet feeding mechanism defined in claim 2 including edge hold-down means engaging the top front edge of the stack for a short distance toward the stack's rear edge, wherein said front edge moves to the rear to clear said edge hold-down means as said band spring unwinds.

4. The sheet feeding mechanism defined in claim 3 wherein the area of contact of said band spring to said top sheet increases with unwinding of said band spring.

5. The sheet feeding mechanism defined in claim 4 wherein said force means includes spring stop means cooperating with said band spring as it is unwound to cause said band spring to engage said top sheet with said increasing force profile and with an increasing area of contact.

6. The sheet feeding mechanism defined in claim 5 including sheet drive means operable to receive said top sheet as it is driven forward by said band spring.

7. The sheet feeding apparatus defined in claim 5 including sheet restraint means engaging the top back surface of said top sheet.

8. The sheet feeding apparatus defined in claim 7 wherein said sheet restraint means includes a second band spring which is wound to retard its engagement of the top back surface of said top sheet away from the front edge, in synchronism with unwinding of said first-mentioned band spring.

9. The sheet feeding apparatus defined in claim 8 including sheet drive means operable to receive said top sheet as it is driven forward by said first mentioned band spring.

10. The sheet feeding mechanism defined in claim 1 wherein said band spring forms a loop which enlarges as said band spring is unwound, and including spring stop means to confine said loop such that said loop engages said top sheet and forces it rearward as the loop expands, and sensing means positioned to sense a desired buckle in said top sheet and operable to cause said band spring to quickly return to said relaxed position.

11. The sheet feeding mechanism defined in claim 10 including a second band spring which operates to restrain the back portion of said top sheets, and means operable to retreat the point of engagement of said second band spring to said top sheet, away from the front thereof, as said loop enlarges.

12. The sheet feeding mechanism defined in claim 11 wherein the area of contact of said first named band spring to said top sheet increases with unwinding of said first named band spring.

13. The sheet feeding mechanism defined in claim 12 including sheet drive means operable to receive said top sheet as it is driven forward by said first named band spring.

14. The sheet feeding mechanism defined in claim 1 wherein said buckle forms as said band spring unwinds to form an enlarging loop therein, and including sensing means operable to sense a desired buckle in said top sheet and to thereupon cause said band spring to return to said relaxed position.

15. The sheet feeding mechanism defined in claim 14 including sheet drive means operable to receive said top sheet as it is driven forward by said band spring.

16. The sheet feeding mechanism defined in claim 15 including a second band spring which engages the top back surface of said top sheet and is wound to retard its engagement to the top sheet away from the front edge, in synchronism with unwinding of said first named band spring.

17. The sheet feeding mechanism defined in claim 16 wherein the area of contact of said first named band spring to said top sheet increases with enlargement of the loop therein.

18. The sheet feeding mechanism defined in claim 1 wherein said force means includes spring stop means cooperating with said band spring as it is unwound to cause said band spring to engage said top sheet with said increasing force profile and with an increasing area of contact.

19. The sheet feeding mechanism defined in claim 18 including sheet drive means operable to receive said top sheet as it is driven forward by said band spring.

20. The sheet feeding mechanism defined in claim 19 wherein said band spring disengages said top sheet after completing the forward drive of said top sheet.

21. In a sheet buckler type sheet feeding mechanism wherein the top sheet of a stack is first subjected to a rearward buckling force, to form a transverse buckle in the top sheet, and is thereafter subjected to a forward drive force to drive the now-separated top sheet into a sheet utilization path, the improvement comprising:

variable force means operable to engage a forward portion of the top sheet and operable to subject the sheet to a variable buckling force, and to thereafter subject the sheet to a forward drive force, said buckling force covering a force range capable of buckling sheets having a wide range of buckling characteristics, movable rear restraint means engaging a rear portion of the top sheet spaced from said variable force means, and synchronizing means interconnecting said variable force means and said rear restraint means such that the distance between the two increases as the buckling force exerted by said variable force means increases.

22. The sheet feeding mechanism defined in claim 21 including buckle sensing means operable to control said variable force means, to cause the same to institute said forward drive force when a given size buckle has been formed in said top sheet.

23. The sheet feeding mechanism defined in claim 22 wherein the area of contact of said variable force means to said top sheet increases as said buckling force increases.

24. The sheet feeding mechanism defined in claim 23 including edge hold-down means cooperating with the top forward edge of the stack, wherein the front edge of said top sheet moves to the rear to clear said edge hold-down means as said buckle is formed.

25. The sheet feeding mechanism defined in claim 24 wherein said sheet utilization path includes sheet drive means operable to receive the now-separated top sheet.

26. A variable force sheet feeding mechanism operable to separate the top sheet from a stack of sheets by first moving the front portion of the top sheet to the rear, to form a buckle therein as the top sheet is separated from the next sheet in the stack, and thereafter to drive the front edge of the top sheet forward into a sheet drive means, comprising:

variable magnitude and direction force means associated with a portion of the front of the top sheet and comprising the sole means for both forming said buckle and for thereafter driving the front edge of the top sheet forward, means mounting said sheet drive means adjacent the top front edge of said stack to be separated therefrom by edge hold-down means which engages the stack's top front edge, cyclically operable means controlling said force means causing said force means to engage said top sheet with a force profile which first increases and thereafter decreases as a function of time, causing the front edge of said top sheet to first move to the rear to clear said edge hold-down means, and to thereafter drive the front edge of said top sheet forward over said hold-down means and into said sheet drive means, as said force means disengages said top sheet and sheet drive means removes said top sheet from said stack, movable rear sheet restraint means engaging a rear portion of the top sheet spaced from said variable force means, and synchronizing means interconnecting said variable force means and said rear restraint means such that the distance between the two increases as the buckling force exerted by said variable force means increases.

* * * * *